United States Patent [19]

Crandall

[11] Patent Number: 4,609,282

[45] Date of Patent: Sep. 2, 1986

[54] APPARATUS FOR PRODUCING AND STACKING INFORMATION COPIES

[75] Inventor: Robert P. Crandall, Rochester, N.Y.

[73] Assignee: Eastman Kodak Company, Rochester, N.Y.

[21] Appl. No.: 761,940

[22] Filed: Aug. 2, 1985

[51] Int. Cl.[4] ..... G03G 15/00

[52] U.S. Cl. ..... 355/3 SH; 355/3 R; 355/14 SH; 355/64; 271/279; 271/287; 271/288; 271/298

[58] Field of Search ..... 355/3 R, 3 SH, 14 SH, 355/38 E, 16, 64, 78, 97, 100, 133; 271/279, 287, 288, 298, 303, 64

[56] References Cited

U.S. PATENT DOCUMENTS

| | | | |
|---|---|---|---|
| 4,072,420 | 2/1978 | Wicks et al. | 355/100 |
| 4,211,483 | 7/1980 | Hannigan et al. | 355/14 R |
| 4,436,404 | 3/1984 | Simmons et al. | 355/3 SH |
| 4,469,322 | 9/1984 | Kogure et al. | 355/3 SH X |
| 4,528,056 | 7/1985 | Hunt et al. | 355/3 SH X |
| 4,531,823 | 7/1985 | Deguchi et al. | 355/3 R |
| 4,534,643 | 8/1985 | Watanabe | 355/3 SH |

*Primary Examiner*—A. C. Prescott

*Attorney, Agent, or Firm*—Lawrence P. Kessler

[57] ABSTRACT

Apparatus producing information copies on interleaved transparency material and plain paper separator sheets, where such separation of the transparency material by the plain paper sheets facilitates handling of the transparency material. The productivity of the apparatus reproduction cycles is enhanced by selectively producing information copies on transparency material or on transparency material and on the separator sheets. After the information copies are produced, the transparency material and separator sheets are selectively stacked in separate receiving hoppers or in interleaved fashion in one receiving hopper.

4 Claims, 6 Drawing Figures

FIG. 1
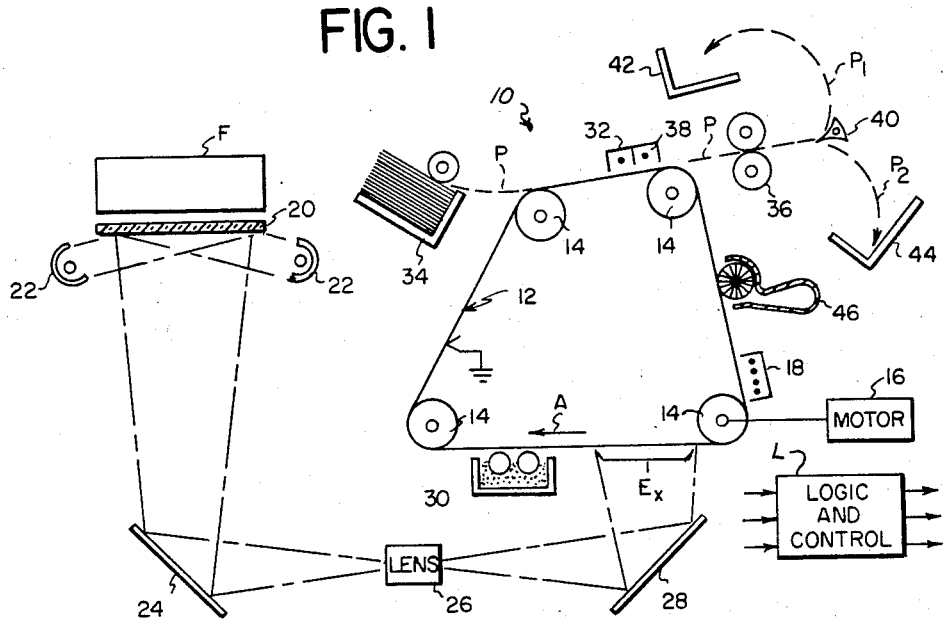
FIG. 3
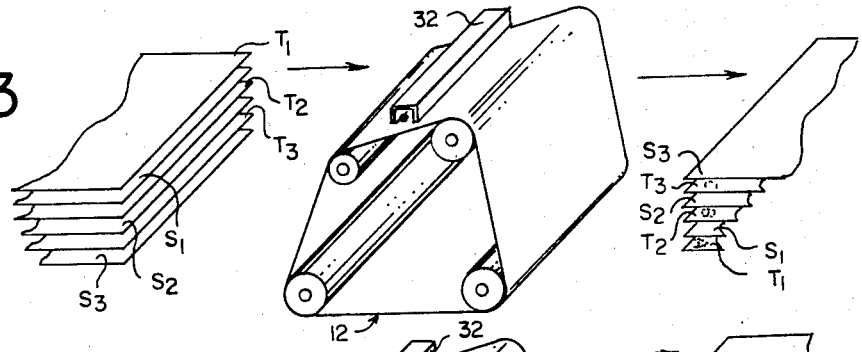
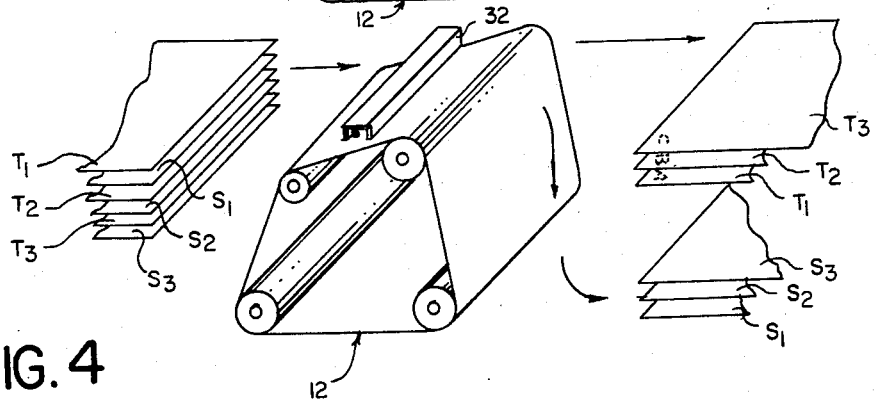
FIG. 4

FIG. 2
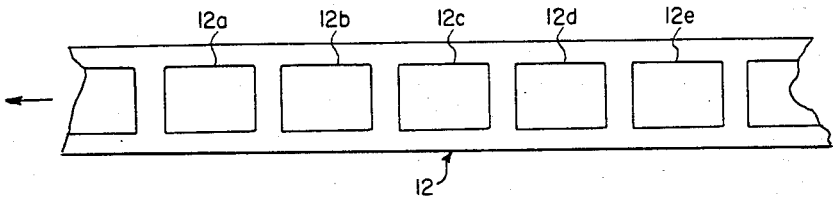
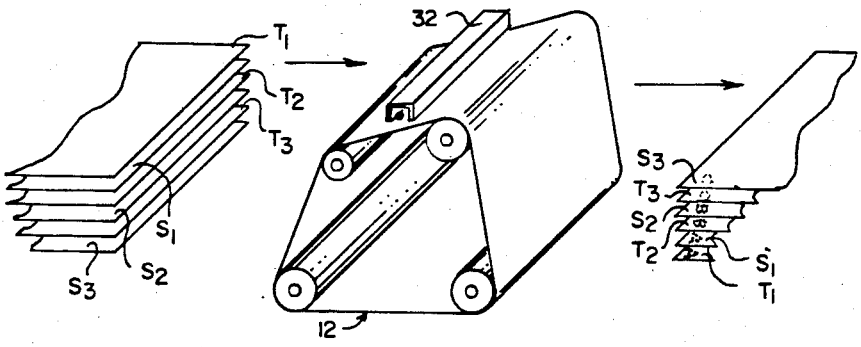
FIG. 5
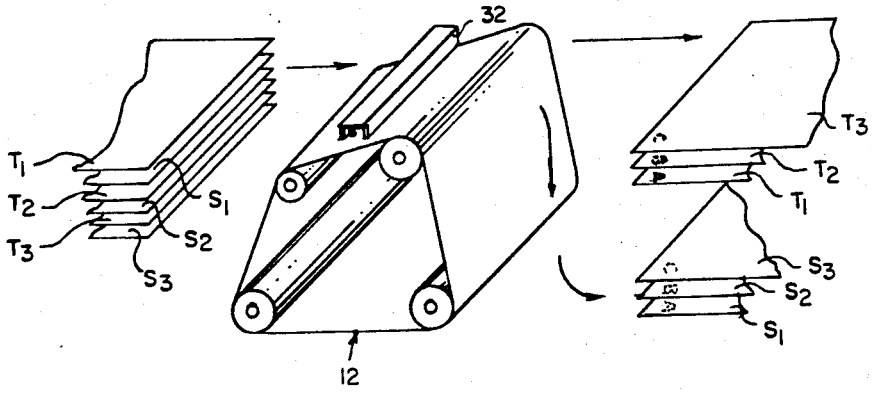
FIG. 6

APPARATUS FOR PRODUCING AND STACKING INFORMATION COPIES

BACKGROUND OF INVENTION

This invention relates generally to producing information copies, and more particularly to producing information copies on interleaved transparency material and plain paper separator sheets and stacking such copies in separate hoppers or in interleaved fashion in one hopper.

One popular medium for communicating information involves displaying the desired information to be communicated on a screen so as to be visible to a substantial member of persons at the same time. Such information is contained on transparency material and is projected therefrom onto the screen, for example, by a projector commonly referred to as an overhead projector. The information-bearing transparency material is typically prepared by producing copies of original information on such transparency material in a reproduction apparatus such as a printer or electrographic copier. Additional copies of such information on plain paper sheets may also be desired. When information copies on both transparency material and plain paper sheets are required, multiple independent copy reproduction cycles are necessitated (i.e., one cycle in which the apparatus functions to produce copies on transparency material and one cycle to produce copies on plain paper).

Transparency material, however, has proven difficult to handle in typical reproduction apparatus. A principle reason for this difficulty has to do with certain inherent characteristics of transparency material. That is, transparency material typically comprises nonfibrous, flexible polymeric sheets which have a relatively high coefficient of friction and a high propensity to surface electrostatic charge build-up. Accordingly, sheets of such material tend to stick together due to such charge build-up and are hard to feed individually through the reproduction apparatus.

SUMMARY OF THE INVENTION

This invention is directed to producing, in a reproduction apparatus, information copies on interleaved transparency material and plain paper separator sheets, where such separation of the transparency material by the plain paper sheets facilitates handling of the transparency material. The productivity of the apparatus reproduction cycles is enhanced by selectively producing information copies on transparency material or on transparency material and on the separator sheets. After the information copies are produced, the transparency material and separator sheets are selectively stacked in separate receiving hoppers or in interleaved fashion in one receiving hopper.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a schematic illustration of a electrographic reproduction apparatus for producing information copies on interleaved transparency material and plain paper separator sheets and stacking such copies, according to this invention;

FIG. 2 is a view of the photoconductive web of the reproduction apparatus of FIG. 1 laid out in planar form, and FIGS. 3 through 6 are schematic diagrams of the respective modes of operation of the reproduction apparatus of FIG. 1, according to this invention.

DESCRIPTION OF THE PREFERRED EMBODIMENTS

Referring now to the accompanying drawings, an electrographic reproduction apparatus, designated generally by the numeral 10, is schematically shown in FIG. 1. The reproduction apparatus 10 includes endless composite web 12 having a photoconductive surface layer and a grounded conductive support layer, such as shown for example in U.S. Pat. No. 3,615,414, issued Oct. 26, 1971, in the name of Light. The web 12, which has a plurality of image receiving areas 12*a*–12*e*, is supported on rollers 14, one of which is selectively driven by motor 16 to move the web about a closed loop path in the direction of arrow A. Typical electrographic process stations are located about the periphery of the web 12 in operative relation with the image receiving areas.

Control of the reproduction apparatus 10 and the electrographic process stations are accomplished by a logic and control unit L including a microprocessor for example. The microprocessor receives operator input signals and timing signals, for example from sensors (not shown) detecting movement of the film web 12 about its closed loop path. Based on such signals and a program for the microprocessor, the unit L produces signals to control the timing operation of the various electrographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

The electrographic process stations function in the following manner. A corona charger 18, coupled to an electrical potential source (not shown), applies a uniform electrostatic charge to the web as it moves past the charger. The uniform charge, in an image receiving area, is altered as the web passes through zone $E_x$ to form an image-wise charge pattern in such area corresponding to information to be copied. For example, the charge pattern is formed by exposure of the image-receiving area of the web to a reflected light image of such information. In the illustrated apparatus 10, exposure is accomplished by utilizing a feeder F, such as described in U.S. Pat. No. 4,169,674 issued Oct. 2, 1979 in the name of Russel, to transport a document of original information to a transparent platen 20, information face down. Lamps 22 reflect off the document and an image of the document information is projected via mirror 24, lens 26, and mirror 28 onto the web in an image receiving area at zone $E_x$. A developer station 30, such as a magnetic brush described in U.S. Pat. No. 3,457,900 issued July 29, 1969 in the name of Drexler, brings marking particles into contact with the moving web. Such particles adhere to the charge pattern to develop the pattern.

The image receiving area containing the developed charge pattern travels about the closed loop path to a transfer station 32 having a corona charger coupled to a D.C. or biased A.C. potential source for example. A receiver member is fed from a supply hopper 34 and transported along a path P to the transfer station in timed relation with moving web so that the receiver member is in register with the developed charge pattern. The charger of the transfer station 32 effects transfer of the developed charge pattern from the image receiving area of the web 12 to the receiver member. After transfer, the receiver member is stripped from the web and transported along path P to a fuser assembly 36, where the transferred pattern is fixed to such member by heat and/or pressure for example. Stripping of the receiver member is facilitated by a corona charger 38, coupled to an A.C. potential source, which neutralizes electrostatic forces holding the receiver member to the web. After the pattern is fixed to the receiver member, the member is directed along path $P_1$ or $P_2$ by a movable deflector 40 to be respectively delivered to output hoppers 42 or 44, as will be more fully discussed hereinbelow, for operator retrieval. Substantially simultaneously, the web 12 moves through a cleaning station 44, where residual (non-transferred) marking particles are removed by a rotating brush for example, and returned to the area of the charger 18 to be conditioned for reuse.

When the reproduction apparatus 10 is utilized for producing and stacking information copies on receiver members which include interleaved transparency material and plain paper separator sheets, according to this invention, the hopper 34 contains a stack of such interleaved transparency material and plain paper separator sheets. The interleaving of transparency material and plain paper separator sheets facilitates sheet handling in the apparatus 10 by reducing the effect of the high coefficient of friction of the transparency material and by preventing transparency material from sticking together due to surface charge build-up. FIGS. 3 through 6 schematically show respective improved operating modes for the apparatus 10, under the control of the logic and control unit L for producing and stacking such information copies. In such figures, the transparency material is designated by the letter T and the plain paper separator sheets are designated by the letter S.

In the first mode of operation (FIG. 3), developed charge patterns corresponding to respective original information are formed in alternate image receiving areas of the web 12 (e.g. 12*a*, 12*c*, 12*e*). Transparency material (e.g. $T_1$, $T_2$, $T_3$) and interleaved plain paper separator sheets (e.g. $S_1$, $S_2$, $S_3$) are fed seriatim through the transfer station 32 of the reproduction apparatus. The unit L controls the timing of transparency material and separator sheet feeding relative to web movement such that the developed charge patterns are respectively transferred only to the transparency material. The deflector 40 is fixed in one position to direct both the transparency material and separator sheets to one output hopper (i.e. hopper 42 if deflector is in solid line position of FIG. 1, or hopper 44 if deflector is in phantom line position). Thus the transparency material and separator sheets are restacked in an interleaved fashion with information copies produced only on the transparency material. In this manner, the restacked transparency material bearing information copy is prevented from sticking together, due to the static charge build-up, by the interleaved plain paper separator sheets.

Under some circumstances the sticking together of restacked, information copy bearing transparency material is of no concern, and thus the separator sheets become surplusage. Therefore, in the second mode of operation (FIG. 4), the deflector 40 is alternately moved to its solid line and phantom line positions in timed relation to the travel of transparency material and plain paper separator sheets to direct the transparency material to one output hopper and the separator sheets to the other output hopper. Accordingly the transparency material, upon which information copies are produced, is restacked for operator retrieval; and separator sheets are separately restacked for disposal or reuse.

Under other circumstances, it is desired to produce information copies on plain paper as well as on transparency material. Therefore, in the third mode of operation (FIG. 5), developed charge patterns corresponding to respective original information to be reproduced, are formed in each image receiving area of the web 12. Each item of original information is held on the platen for two exposure cycles so that the same information appears in two adjacent image receiving areas (e.g 12*a*, 12*b*). Thus, when the transparency material and plain paper separator sheets are fed seriatim through the transfer station 32, under the control of unit L, developed charge patterns are transferred to both the transparency material and the separator sheets, with the same information reproduced on a sheet of transparency material and its immediately following separator sheet. The deflector 40 remains fixed in one position to direct the transparency material and separator sheets to one output hopper. Accordingly, the transparency material and plain paper separator sheets are restacked, in order with duplicate information copies following one another, in interleaved fashion.

In the fourth mode of operation (FIG. 6), information copies are similarly produced as in the third mode of operation on both transparency material and plain paper separator sheets, and the deflector 40 is alternately moved (as in the second mode of operation) to its solid line and phantom line position. Accordingly, transparency material bearing information copies are stacked in order in one output hopper, and plain paper separator sheets bearing information copies are stacked in order in the other output hopper.

The invention has been described in detail with particular reference to the preferred embodiment thereof, but it will be understood that variations and modifications can be effected within the spirit and scope of the invention.

I claim:

1. An improvement for apparatus producing information copies on transparency material interleaved with plain paper separator sheets as copy receiver members, said improvement comprising:

means for selectively stacking such transparency material and such separator sheets after information copies are produced, in separate stacks, or in interleaved fashion in one stack.

2. The invention of claim 1 further including means for controlling said apparatus for selectively producing information copies on such transparency material only, or in duplicate on such transparency material and on such separator sheets.

3. Information copy reproduction apparatus having a plurality of copy receiving output hoppers and utilizing transparency material interleaved with plain paper separator sheets as copy receiver members, said apparatus comprising:

means for selectively producing information copies on such transparency material, or on such transparency material and on such separator sheets; and means selectively stacking such transparency material and such separator sheets, after information copies are produced, in separate output hoppers, or in interleaved fashion in one output hopper.

4. In an apparatus for producing information copies on receiver members, said apparatus having a supply hopper adapted to contain receiver members including sheets of transparency material interleaved with separator sheets of plain paper to facilitate handling of such transparency material sheets, a station for producing information copies on receiver members, first delivery means for delivering receiver members seriatim from said supply hopper to such information copy producing station, a plurality of output hoppers for receiving receiver members, and second delivery means for delivering receiver members from said information copy producing station to said output hoppers, means for controlling operation of said apparatus comprising:

means for actuating said first delivery means to deliver receiver members to said information copy producing station;

means for selectively activating said information copy producing station to effect production of information copies on sheets of transparency material only, or production of duplicate information copies on sheets of transparency material and sheets of plain paper respectively;

means for actuating said second delivery means to selectively deliver all receiver members from said information copy producing station to one of said output hoppers, or transparency material to a first output hopper and plain paper sheets to a second output hopper, whereby receiver members are stacked (1) with sheets of information-bearing plain transparency material and information-bearing plain paper interleaved in such one output hopper; (2) with sheets of information-bearing transparency material and information-bearing plain paper in such first and second output hoppers respectively (3) with sheets of information-bearing transparency material interleaved with sheets of noninformation-bearing plain paper in such one output hopper; or (4) with sheets of information-bearing transparency material in such first output hopper and sheets of noninformation-bearing plain paper in such second output hopper.

* * * * *